United States Patent [19]

Frehn

[11] 4,386,959

[45] Jun. 7, 1983

[54] METHOD FOR COMPOUND SINTERING

[75] Inventor: Fritz Frehn, Krefeld, Fed. Rep. of Germany

[73] Assignee: Thyssen Edelstahlwerke AG, Krefeld, Fed. Rep. of Germany

[21] Appl. No.: 163,960

[22] Filed: Jun. 30, 1980

[30] Foreign Application Priority Data

Jul. 17, 1979 [DE] Fed. Rep. of Germany ..... 2928792

[51] Int. Cl.[3] ..... B22F 5/00

[52] U.S. Cl. ..... 419/8; 228/197

[58] Field of Search ..... 75/208 R; 228/196, 197

[56] References Cited

U.S. PATENT DOCUMENTS

| | | | |
|---|---|---|---|
| 3,716,347 | 2/1973 | Bergstrom | 75/208 R |
| 3,717,442 | 2/1973 | Knopp | 75/208 R |
| 3,744,120 | 7/1973 | Burgess et al. | 228/196 |
| 3,795,511 | 3/1974 | Niimi et al. | 75/208 R |
| 3,889,349 | 6/1975 | Kaufman | 75/208 R |
| 4,029,476 | 6/1977 | Knopp | 75/208 R |
| 4,289,833 | 9/1981 | Hichisuka | 75/208 R |

*Primary Examiner*—Brooks H. Hunt

*Attorney, Agent, or Firm*—Kenyon & Kenyon

[57] ABSTRACT

Joined connections between a metallic compact body made by melting metallurgy and a body made by powder metallurgy are prepared by providing a pre-formed, unsintered pressed body having at least one component which forms a liquid phase at the sintering temperature, placing the pre-formed body directly in contact with a metallic compact body without application of external pressure and subjecting the contacted bodies to a temperature sufficient to sinter the pressed body but below the liquidus temperature of the compact body.

4 Claims, No Drawings

METHOD FOR COMPOUND SINTERING

BACKGROUND OF THE INVENTION

The invention relates to metallurgy in general and more particularly to a method for joining bodies made by powder metallurgy to compact bodies by compound sintering, and to the application of this method to the joining of pressed bodies of steel bonded hard material, especially a metal carbide, and preferably titanium carbide, to steel.

It is an object of the present invention to describe a method which is as economical, i.e., as cost-effective as possible, and with which it is possible to pair a tough, solid, compact base body, for instance, of steel, with a highly wear-resistance body made by powder metallurgy. Generally, highly wear-resistant materials have too high a content of hard materials (metal nitrides, borides, silicides and carbides) that they cannot be produced by melting metallurgy. They are therefore produced by powder metallurgy, the hard material component in powder form being mixed, pressed and sintered with a metallic binder, likewise in powder form.

Methods for joining of compact bodies of the same or different composition are known in the art. "Industrie-Anzeiger" 1968, pages 18 to 23, generally teaches joining by pressure welding. This is carried out by heating up the bodies to be joined together, compression with low pressure without deformation, and sintering together in a vacuum or in a protective gas, optionally with metallic intermediate layers (diffusion welding). The sintering together of two pressed bodies or two sintered bodies, optionally with powdering the contact surfaces with a material of high vapor pressure, is described in German Pat. No. 867 164. Placing pressed or sintered bodies on top of one another after first machining the contact surfaces by chip removing methods and sintering together is disclosed in German Auslegeschrift No. 14 71 078.

It is a common feature of all these known methods that their objective is only the joining of similar bodies. Therefore, either pressed bodies are joined together or sintered or solid bodies are joined. The sintering together of bodies with different starting structure, i.e., for instance, pressed bodies to sintered bodies or pressed bodies to solid bodies has been performed heretofore only after hot pressing. In this case, a bed of powder or a pre-pressed body is placed on the compact, i.e., solid, base body, and the former is then pressed against the compact body at high pressure and high temperature. Subsequently, the compound sintering is performed. While this hot pressing leads technically to a usable product, it has the disadvantage that it requires a large amount of equipment and energy for generating the pressure and the temperature and is therefore very expensive.

Another method is known (German Pat. No. 21 39 738), by which a compound body can be produced from two different materials in such a manner that a bed of the different powders is prepared in two layers; these are then pressed and subsequently sintered. This method, however, only makes possible the fabrication of a power metallurgy compound product, but not the joining of a power metallurgy product to a compact body.

SUMMARY OF THE INVENTION

To solve the problem underlying the present invention, according to the present invention, a pressed body of a material with at least one component which forms a liquid phase at the sintering temperature is placed without pressure and directly on the surface of a compact body, and both parts are firmly joined together by sintering in a vacuum or in a protective gas at a temperature below the liquidus temperature of the compact body. The sintering is therefore performed without the application of pressure, without an intermediate layer (solder) and without mechanical machining of the contact surfaces.

Depending on the type of the materials, the sintering temperature should be in the range of 1100° to 1400° C.

The fact that it is possible to obtain, with the method according to the present invention, a tight bond between the body made by powder metallurgy and the compact body, must be considered as surprising in view of the many efforts in other directions. In particular, the fact that a satisfactory bond can be established without the application of pressure was unexpected. This follows from the fact that it was considered necessary to press the powder on, prior to the sintering, further under very high pressure by explosive densification. Dispensing with the application of pressure altogether must have appeared as impossible to an expert. While the pressed body shrinks extremely heavily during the sintering, there is practically no shrinkage in the compact body, so that it has to be assumed that a good bond between the two would not occur unless additional measures were taken such as hot pressing or the interposition of solder.

The advantage of the method according to the invention consist of eliminating:

- expensive hot-pressing;
- use of solder;
- an additional process step for fabricating a sintered body from the pressed body, to subsequently prepare the bond by the known diffusion welding; and
- mechanical preparation of the parts to be joined together.

Special advantages are obtained if the method according to the invention is applied to the joining of pressed bodies of steel bonded hard material, especially a metal carbide and preferably titanium carbide, to steel. Steel bonded hard material has high wear resistance and, if the steel binder is chosen appropriately, has, in addition, high corrosion resistance and, in the soft annealed condition, can readily be machined by chip removal and can subsequently be brought to a higher hardness by a heat treatment.

DETAILED DESCRIPTION OF THE INVENTION

The following example serves to explain the method according to the present invention.

EXAMPLE

Stainless steel, material No. 4006, with 0.08% C, 12 to 14% Cr and the remainder iron, was sintered, after degreasing, with a pressed body consisting of 20% by weight titanium carbide and 80% by weight of a martensitic nickel steel alloy of 15% Mo, 13% Ni and 15% Co, 0.8% Nb, 0.02% B and the remainder Fe, without solder and without application of pressure at a sintering temperature of 1280° C. in a vacuum of $10^{-3}$ Torr. It could be determined by means of a polished section that a very good bond between the pressed body and the compact body was obtained.

After a solution heat treatment at 840° C. and cooling by air or gas, the hard material alloy layer had a hardness of 50 HRC. After machining by planing, a precipitation hardening treatment for 6 hours at 480° C. was performed, whereby the hardness could be increased to 69 HRC without damage to the joint.

The method according to the present invention can be used to advantage for the manufacture of such parts which must exhibit, in some sections, increased wear resistance and, in other sections, higher toughness, such as casting shovels for sand blasting machines, or dies and punches for processing highly abrasive materials such as ceramics, carbides, nitrides etc. Plating of ring nozzles and cutting knives for the production of plastic granulate is a further field of application.

The size of the parts which can be produced by the method according to the present invention is not subject to any limitation. In contrast thereto, in the known hot pressing process, the magnitude of the pressure forces that must be supplied, limit the size of the compound parts that can be produced. For certain parts with a large surface, the method according to the present invention is therefore of particular advantage. Such large parts which could not be produced by hot pressing could be produced by high temperature soldering, but the cost of such a process is higher and a bond as good as with the method according to the present invention is not achievable.

I claim:

1. A method for forming a joined connection between a sintered pressed body made by powder metallurgy and a metallic compact body, said method consisting essentially of:

(a) providing an unsintered pre-formed pressed body made from a mixture of powdered metallurgical components, at least one of said components forming a liquid phase at the sintering temperature of the pressed body;

(b) placing a surface of said pressed body directly in contact with a surface of a metallic compact body, made by melting metallurgy, without applying external pressure; and (c) subjecting the contacted pressed body and compact body, in a vacuum or a protective gas atmosphere, without application of external pressure, to a temperature below the liquidus temperature of the compact body but sufficient to sinter said pressed body, thereby firmly joining together the compact body and the sintered pressed body.

2. The method according to claim 1 wherein said pressed body is a steel bonded hard material.

3. The method according to claim 2 wherein said hard material is a metal carbide.

4. The method according to claim 3 wherein said metal carbide is titanium carbide.

* * * * *